US008864690B2

(12) United States Patent
Fuster

(10) Patent No.: US 8,864,690 B2
(45) Date of Patent: Oct. 21, 2014

(54) MASSAGE HEAD AND MASSAGE APPARATUS EMPLOYING SAID HEAD

(75) Inventor: Arnaud Fuster, Beaumont les Valence (FR)

(73) Assignee: LPG Finance Industrie, Valence (FR)

( * ) Notice: Subject to any disclaimer, the term of this patent is extended or adjusted under 35 U.S.C. 154(b) by 1151 days.

(21) Appl. No.: 12/492,289

(22) Filed: Jun. 26, 2009

(65) Prior Publication Data

US 2010/0036298 A1 Feb. 11, 2010

(30) Foreign Application Priority Data

Aug. 8, 2008 (FR) ..... 08 55487

(51) Int. Cl.
*A61H 7/00* (2006.01)

(52) U.S. Cl.
CPC ..... *A61H 7/005* (2013.01); *A61H 7/008* (2013.01); *A61H 7/007* (2013.01)
USPC ..... 601/133; 601/134; 601/6; 601/103; 601/111

(58) Field of Classification Search
CPC ..... A61H 7/005; A61H 7/007–7/009
USPC ..... 601/6–10, 46, 50, 53–55, 67, 69–70, 601/75, 84–85, 87–89, 93–94, 96, 112, 134, 601/12, 133, 135–137, 97, 103, 111; 606/201, 204, 204.14, 204.15
See application file for complete search history.

(56) References Cited

U.S. PATENT DOCUMENTS 2,232,493 A * 2/1941 Stuckey et al. ..... 15/22.1
5,843,006 A * 12/1998 Phillips et al. ..... 601/133
5,961,475 A * 10/1999 Guitay ..... 601/7
6,251,089 B1 * 6/2001 Kuznets et al. ..... 601/95
6,517,499 B1 * 2/2003 Pereira ..... 601/7
2003/0073937 A1 * 4/2003 Guitay ..... 601/6
2006/0235339 A1 * 10/2006 Naldoni ..... 601/2

FOREIGN PATENT DOCUMENTS

| | | | |
|---|---|---|---|
| DE | 393167 | C | 3/1924 |
| DE | 4223516 | C1 | 7/1993 |
| EP | 0917452 | A1 | 5/1999 |
| FR | 1225094 | A | 6/1960 |
| FR | 1420499 | A | 12/1965 |
| FR | 0224422 | A1 | 11/1986 |

OTHER PUBLICATIONS

Search Report for FR0855487 dated Feb. 11, 2009.

* cited by examiner

*Primary Examiner* — Patricia Bianco
*Assistant Examiner* — Kari Petrik
(74) *Attorney, Agent, or Firm* — Heslin Rothenberg Farley & Mesiti PC; Victor A. Cardona, Esq.

(57) ABSTRACT

This massage head is fitted with a case defining an internal chamber in which a skinfold is formed when it is applied to the skin of a patient. The fold presses against the lower edges of the chamber, which is defined by two lateral walls and by two transverse walls The transverse walls each include a clack valve able to be driven in a pivoting motion, so as to cause the lower edges of the clack valves in contact with the skinfold to come closer together or move further apart. The relative displacement of the clack valves is ensured by of a motorized rotary cam provided in the massage head. The cam defines a cam path engaging with a component associated with the clack valves, and able to cause the swivelling motion thereof.

15 Claims, 8 Drawing Sheets

MASSAGE HEAD AND MASSAGE APPARATUS EMPLOYING SAID HEAD

CROSS REFERENCE TO RELATED APPLICATIONS

This application claims priority from French patent application No. 0855487 filed on Aug. 8, 2008, the entire disclosure of which is incorporated herein by reference.

FIELD OF THE INVENTION

The present invention relates firstly to a massage head, for mobilizing the skin tissue. It then relates to a massage device employing said head.

The target objective of the invention is to conduct massage operations straightforwardly and effectively and to conduct them both on human beings and on animals.

PRIOR ART

Different massage techniques are known and generally depend on the treatment to be applied. Generally speaking, they aim to put stress on the patient by applying pressure to and/or moving and/or pinching the skin tissue in particular.

To facilitate action by the masseur, a large number of devices have been proposed. Among these the initial proposal was for devices to be employed that use a straightforward mechanical action, for example using assemblies comprising beads or balls mounted onto a carrier case, so that where appropriate a cream or gel preparation can be dispensed or applied concomitantly, as described for example in the document FR-A-1 225 094.

A proposal has also been made for this mechanical treatment to be combined with suction treatment applied to the patient's skin. To this end, the massage appliances concerned employ a treatment head connected to a suction system, said treatment head comprising a carrier case defining an internal chamber into which the suction system leads. When the massage head is applied against the patient's body, and because of the suction generated by the suction system, a skinfold is formed inside the internal chamber, with said skinfold pressing against the peripheral edge of said internal chamber.

The mechanical action can be applied by rollers, or beads which concomitantly with the suction can bring pressure and/or movement and/or friction to bear on the patient's body, particularly by vibration.

The solutions proposed in this context lead to complex assemblies, which are awkward to use and which do not give complete satisfaction in terms of results.

Massage appliances have also been proposed that are able to provide a straightforward duplication of palpating and rolling massages, i.e. those involving the application of continuous action to the patient, prompting not only localized pinching of the skin tissue, but also gradual movement of the pinched area so that said skinfold is rolled while pressure is applied (see for example EP-A-224 422).

Such appliances thereby comprise a case that can be activated manually inside which are mounted two parallel rollers, mounted to rotate freely or to be actively rotated inside the case. Said rollers may be mounted on the case with a fixed distance between centres, or conversely are able to diverge and come closer together automatically during the massage operation, said case being itself connected to suction means for the creation of negative pressure between said rollers when the head complete with said different elements is applied against the patient's body, in order to form a skinfold that presses against the surfaces of the rollers.

In the document EP 0 917 452, the proposal is to replace the rollers concerned with two partitions added into the case and articulated therein so as to be able to be driven in a swivelling motion, said case being, in this instance also, connected to a suction source. Under suction action, a skinfold is created that is inserted between the two partitions inside the case. Given the advance in one direction or the other of the massage head fitted with said device against the patient's skin, the fold of skin so formed sustains spasmodic pinching.

Said device may be improved through the use of a solenoid valve in the suction system, which provides an on-off operating control, but which also means that a controlled rate of airflow can be specified between two pre-set values, with the possibility of adjustment between said values.

Said solenoid valve mounted in the suction system therefore gives a rhythm pulse sequential operation, such that during the massage operation, the suction rate varies cyclically, thereby causing an effect of vibration, of variation in the strength of suction and skin take-up, thereby improving the effectiveness of the treatment and additionally facilitating the implementation thereof.

In the absence of stress, the two partitions are kept apart from each other by means of springs or magnets for example, said partitions being made to swivel and therefore brought closer relative to one another as a result of the effect of the vacuum and/or negative pressure generated inside the case.

Although there is no question as to the satisfactory nature of the device described in this document, it does on the other hand turn out that, due to unavoidable leakage between the lower end of the case and the patient's skin against which it is applied, the vacuum or negative pressure may be broken quickly, thereby affecting the effectiveness of the treatment and, particularly, the pinching action resulting from the two partitions.

What is more, it is not unusual to find one or both partitions getting jammed on account of the vacuum, which then affects treatment effectiveness in a more significant way.

The objective of the present invention is to optimize the operation of the device described in this document and particularly the effectiveness of the pinching resulting from the action of said partitions.

DISCLOSURE OF THE INVENTION

To this end, the present invention is targeted at a massage head fitted with a case defining an internal chamber in which a skinfold is formed when it is applied to a patient's skin, said fold being pressed against the lower edges of the chamber. Said chamber is defined by two lateral walls and two transverse walls, said transverse walls each comprising a clack valve capable of being driven in a swivelling motion, to cause the lower edges of said clack valves to be brought closer together or moved further apart on contact with the skinfold.

According to the invention, the relative displacement of the clack valve is ensured by means of a motorized rotary cam provided within the massage head, said cam defining a cam path receiving a ball joint added at the end of the clack valves, opposite their free lower edge in contact with the patient's skin.

In other words, the invention involves firstly replacing the suction source in its function of displacing the clack valves or transverse partitions with a purely motorized action resulting from the engagement of components mounted on said partitions with a rotary cam, the cam path whereof has at least one eccentric.

The skinfold is therefore the result of mechanical grabbing generated by the free lower edge of the clack valves. This is to advantage coated with a material with a high friction coefficient, such as an elastomer for example.

This then reproduces the technology known as "pinch of Jacquet" whereby a succession of pressures is applied to the whole depth of the skin and in every direction.

Actuating the clack valves mechanically to produce said skinfold has the advantage of guaranteeing that the clack valves will return to their original position, contrary to prior art devices that employ suction alone, which may lead to said clack valves "sticking" together, nullifying all action of the massage head.

According to the invention, the cam comprises only one cam path for the two ball joints of the two clack valves. As already said, said cam path is not circular, but has at least one eccentric. However, said cam path is symmetrical in order to cause the free lower edges of said clack valves to come closer to one another or conversely to move further apart simultaneously and concomitantly.

Said cam path may be ellipsoidal but also assume a substantially star-shaped profile and generally any symmetrical profile, depending on the required number of operations to bring the free lower edges of the clack valves closer and move them further apart by fully rotating said cam.

According to one inventive feature, the ball joints received in the cam path are mounted at the end of an axis integral with the clack valves.

Additionally, the ends of the clack valves, opposite their free lower edge, are articulated on a clack valve carrier precisely so that they can swivel and particularly so that the free lower edges can come closer to one another or move further apart.

Said articulation may arise from a resilient hinge.

The assembly comprising the clack valve carrier and the clack valves themselves may comprise a part made out of a plastic material cast in one piece.

According to one inventive alternative, the active area of the massage head comprises:

- a clack valve carrier, secured to said head, and comprising two rigid sub-plates articulated on said carrier, said sub-plates extending in the direction opposite to the free edge of the clack valves via a component capable of engaging with the rotary cam;
- an active part, which is fixed onto the other end of the sub-plates, and intended to come into contact with the skin.

This alternative means firstly that production of the inventive massage head can be simplified. Indeed, the clack valve carrier fitted with its two sub-plates may be cast in one piece, and in particular made out of plastic, and provide a thinned down area to form a hinge. It further means that the active part is adjustable, in terms of geometric shape and the nature of its constituent material, such as flexible, abrasive, scented, cold effect material. Said material may for example comprise polypropylene, polyethylene or polyurethane.

According to a more developed inventive alternative, an additional degree of freedom can be added in order to move the clack valves, constituted in the case in point by a movement thereof in accordance with the principal dimension of the massage head.

To this end, the clack valves are each fitted with an aperture orientated in accordance with the principal dimension thereof, and extending in the upper area thereof, said aperture engaging with a perpendicular axis issuing from the clack valve carrier.

Moreover, said clack valves are each subject to the action of a resilient return component, comprising in the case in point a spring, causing them to be placed, in the absence of any stress, in the upper position, in other words, causing the ball joints to be placed against the rotary cam. In doing this, the action of the massage head is optimized, making the use of a conventional suction source unnecessary.

What is more, on account of this additional "vertical" movement of the clack valves a "face-lift" effect is induced, since when they are closed, they cause the skinfold not only to be pinched, but also pulled. Skin treatment in terms of elasticity, tone and firmness of the skin is thus optimized.

According to another inventive alternative, it is however conceivable to combine conventional suction means known from the prior art with the massage head, with the suction pipe leading into the internal chamber. In this event, skinfold formation is improved or facilitated, and above all, the option is provided of acting in a combined way by applying a suction action which may or may not be continuous with a massage action which is rhythmical and therefore discrete, caused by the action of the motorized clack valves. This combination of effects, whether the frequencies of clack valve opening and closing, and suction phase respectively, are or are not synchronous, can be used to optimize the blood and lymphatic circulation process.

The invention also relates to a massage device employing said massage head. This massage device comprises an electrical energy source suitable for activating the electric motor built into the massage head and charged with rotating the cam. It is also able to include a vacuum or negative pressure source associated with the massage head when it is provided therewith.

BRIEF DESCRIPTION OF THE FIGURES

The way in which the invention can be embodied and the resulting advantages thereof will become clearer from the following embodiment example, given for information purposes and non-restrictively, supported by the appended figures.

DETAILED DESCRIPTION OF THE INVENTION

Figure 1:
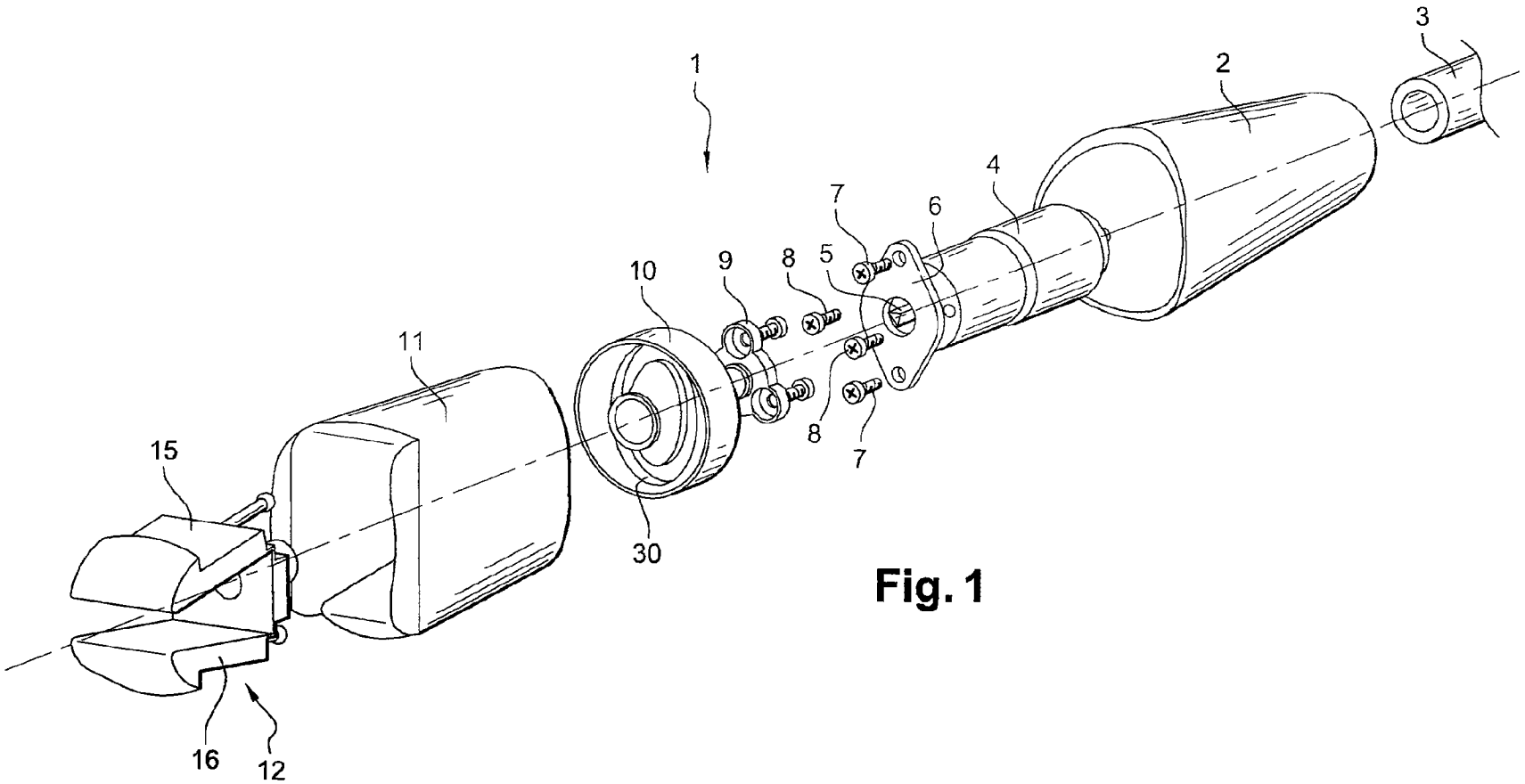
FIG. 1 is a diagrammatic representation in exploded perspective of the inventive massage head.
Figure 2:
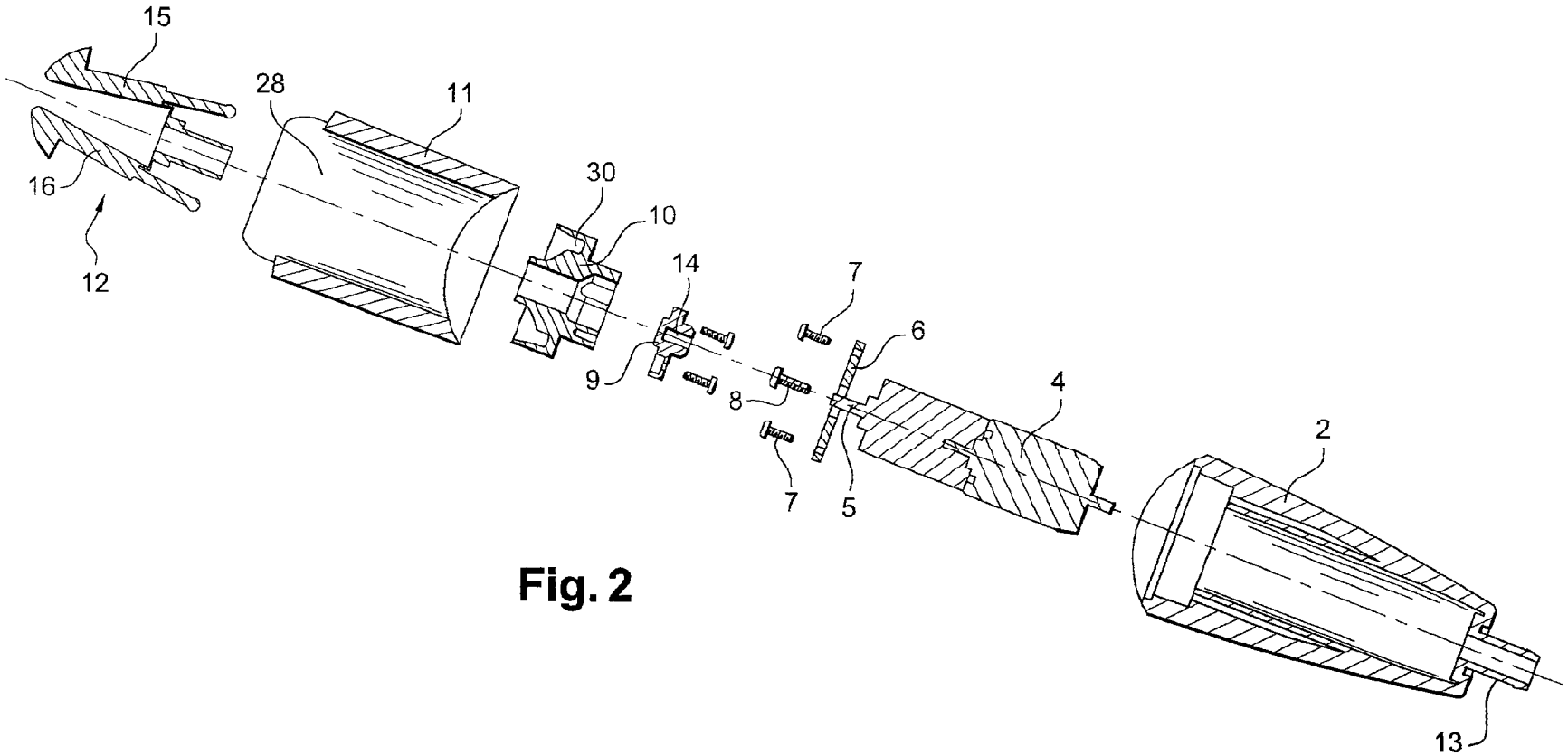
FIG. 2 is a diagrammatic representation also exploded of a massage head seen in sagittal cross-section.

It comprises a case formed of two parts 2, 11 joined together by being snapped on, bonded or screwed, made for example out of plastic material (and for example out of POM (polyoxymethylene), ABS or polycarbonate for the back part 2, and polycarbonate, particularly transparent polycarbonate for the front part 11), and defining a volume within which the mechanical elements that operate the head are received.

Said case also acts as a handle that can be gripped by the user so that the massage head can be applied against the body of a patient.

The back part 2 of said case is fitted with a through orifice that is extended by a channel 13, to which a pipe 3 can be fitted, connected to a vacuum or negative pressure source when the massage appliance employing the head 1 is fitted therewith.

The front part 11 of said case defines an internal chamber and receives an assembly 12 that includes two clack valves 15 and 16 able to swivel around an axis perpendicular to the principal head dimension, such that the free lower edges thereof 17, 18 get closer to each other or move further apart from each other, as will be described in further detail below.

The back part 2 therefore defines an internal volume for the reception firstly of an electric motor 4, fastened to the internal lateral wall of said part by means of an attachment plate 6 screwed into slits 34 provided in said wall. Said plate 6 is drilled at its centre with a through orifice for passing through the axis of rotation 5 from the motor 4, and intended to rotate a cam 10, this too being described in further detail below.

The electric motor used may be of the direct current or brushless type. It is combined with a reducer, to give the torque required to activate the clack valves. When a brushless motor is used, an encoder may to advantage be attached to it, so that the drive shaft exit velocity and, consequently, the valve flutter frequency can be controlled.

Said plate 6 is also secured to the lower end of the motor 4 by additional screws 8.

The rotary axis 5 of the electric motor 4 is received and bonded in a housing 14 provided in a plate 9, secured by screws to the rear face of the rotary cam 10.

The rotary cam 10 is itself guided to fit within the body 2.

The front face of the cam defines a cam path 30 intended to engage with appropriate means associated with the clack valves 15 and 16, as described in further detail hereinafter.

Said cam 10 is drilled at its centre with a through duct 29, coaxial with its axis of rotation, and intended for passing through a means for securing the assembly 12 that includes said clack valves and in particular a "caudron" fitting or thickened area.

Said cam 10 is made to advantage out of an injection moulded plastic material, and typically out of POM, so that its mechanical characteristics, particularly in terms of guidance, friction and wear, can be guaranteed.

The internal chamber defined by the front part 11 of the case constituting the massage head comprises two partitions opposite one another 28 and the two clack valves 15 and 16 included in the assembly 12.

Figure 5:
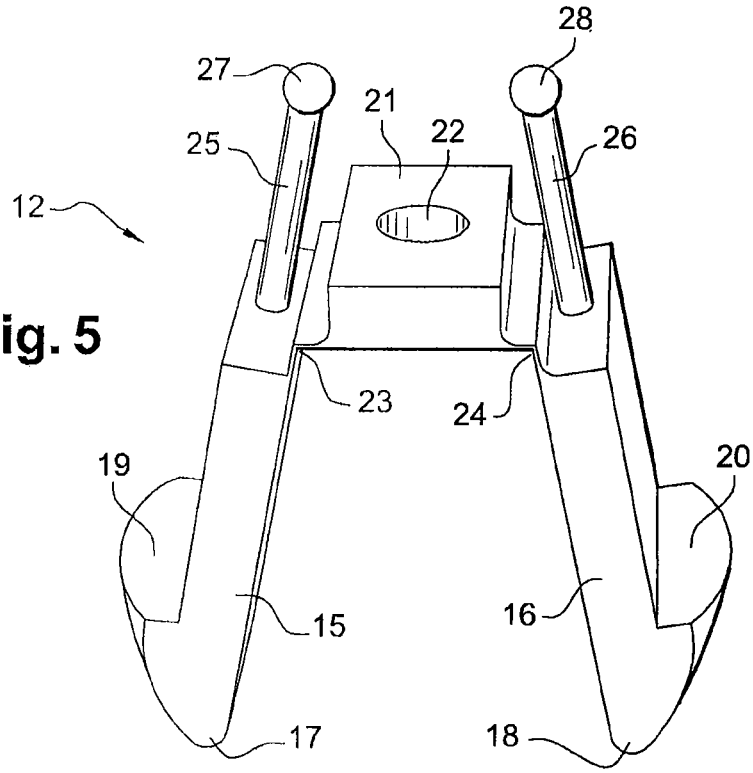
FIG. 5 is a diagrammatic representation in perspective of the characteristic inventive clack valves.

Said assembly 12 includes a "caudron" fitting attachment system, as previously described, associated with a platform 21, also fitted with a through orifice 22, collinear and coaxial with the "caudron" fitting and with the through duct 29 provided in the cam 10. Said clack valves 15 and 16 are in fact articulated by their upper end opposite the free edges 17 and 18 on said platform 21, as can in fact be seen in FIG. 5. Said articulation may to advantage comprise a resilient hinge of a type known per se.

Additionally, said upper end of the clack valves 15 and 16, opposite the free lower edges 17 and 18 is each extended by an axis 25 and 26, perpendicular to the articulation axis of said clack valves on the platform 21, and whereof the free end is provided with a ball joint 27 and 28 respectively, intended to engage with the cam path 30 provided in the cam 10.

To advantage, the assembly comprising the two clack valves, the platform 21, the axes 25 and 26 and the ball joints 27 and 28 is made out of a plastic material and comprises one single and identical part. Whatever the circumstances, each of the axes 25 and 26 is rigidly secured to the clack valve related thereto, so as to cause it to move relative to the articulation axis thereof, as a function of the tracking of the corresponding ball joint 27 and 28 in the cam path 30.

Figure 3:
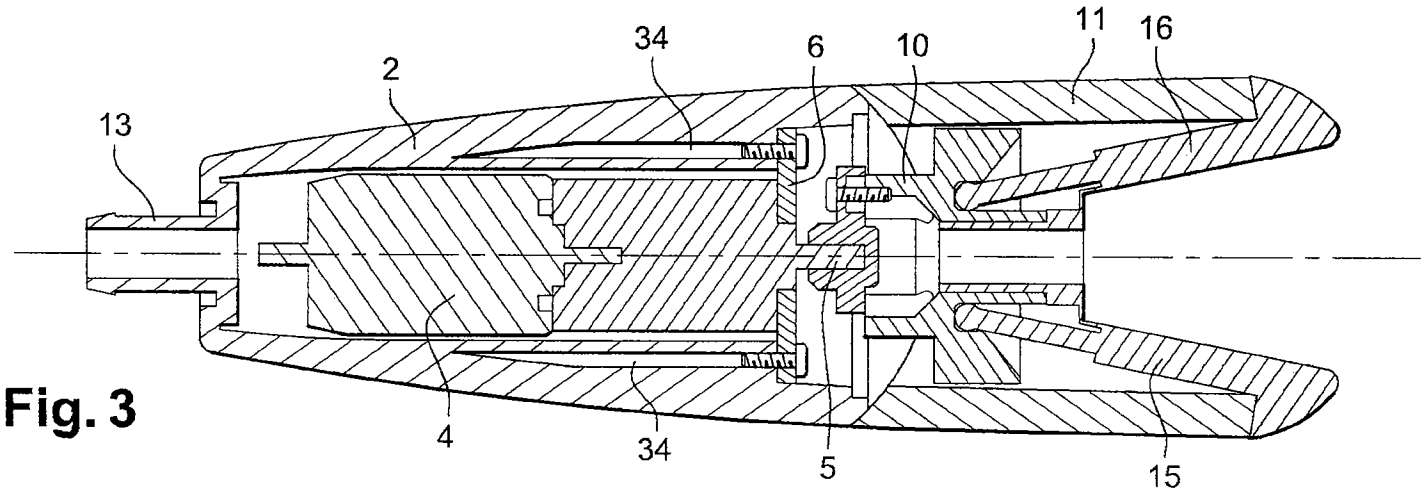
FIG. 3 is a diagrammatic representation in sagittal cross-section of the massage head assembled in accordance with the invention, with the clack valves fitted thereto being in the moved apart position relative to one another.
Figure 4:
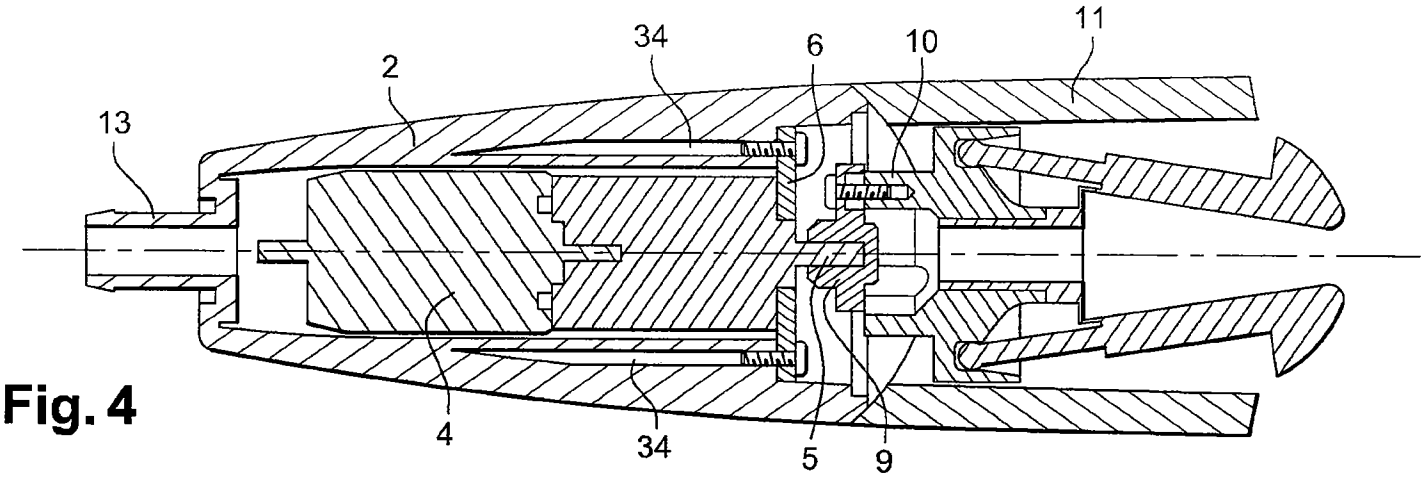
FIG. 4 is a view similar to FIG. 3 but wherein the clack valves are in the moved closer position relative to one another.

The free lower edge 17 and 18 of the clack valves 15 and 16 is to advantage convex in shape, to promote contact with the patient's skin. Furthermore, said clack valves, when they are in the moved apart position relative to one another, as is shown for example in FIG. 3, are pressed against the front end of the front part 11 of the massage head case and have to this end a shoulder 19 and 20 respectively.

Because of the articulation 23 and 24 of the clack valves on the platform 21, it can therefore be seen that the clack valves 15 and 16 can be brought closer to each other or moved further apart within the internal chamber defined by the front part 11 of the case, said movement occurring in a plane parallel to the lateral walls 28 that also define the internal chamber of the massage head.

Figure 6:
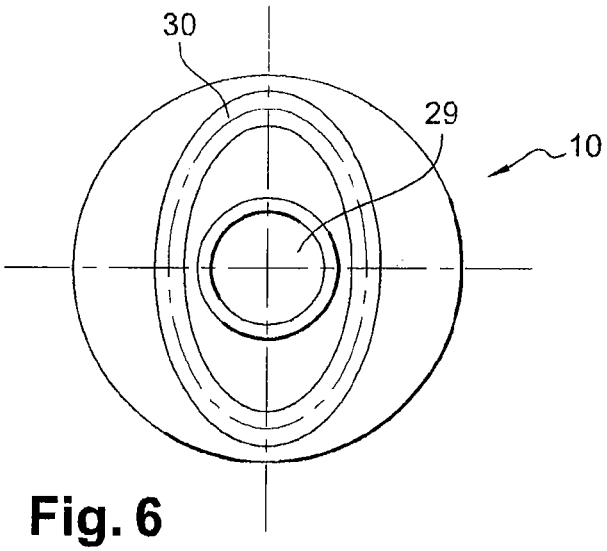
FIG. 6 is a diagrammatic representation seen from above of the inventive cam in a first embodiment.

In accordance with the invention, the cam path 30 of the cam 10 displays symmetry relative to at least one axis passing through the plane of which it is part and through the centre of rotation of said cam. It has additionally at least one eccentric. In the embodiment shown in FIG. 6, said cam path is ellipsoidal in shape. In so doing, the ball joints 27 and 28 of the two clack valves 15 and 16 exactly follow a profile symmetrical with each other relative to a plane passing through the axis of rotation of the cam on the one hand and perpendicular to the lateral walls 28. With the ellipsoidal profile shown in FIG. 6, each 360° rotation of the cam 10 in fact causes two flutters of each of the two clack valves.

Figure 7:
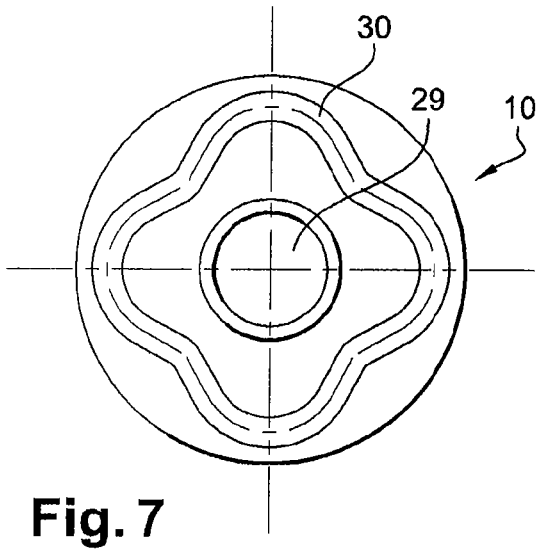
FIG. 7 is a view similar to the previous one in a second embodiment.

On the other hand said cam path may adopt other profiles, still symmetrical and for example a profile of the type shown in FIG. 7. In this configuration, each 360° rotation of the cam 10 causes four flutters of each of the clack valves.

It can be seen that by adapting the rotation speed of the motor 4, and therefore of the cam 10, a choice can be made of the speed and number of flutters of said clack valves, and therefore of the intensity of the treatment and in particular of the pinching generated by the clack valves.

Consequently, the effectiveness of this pinching action is optimized significantly.

Figure 8A:
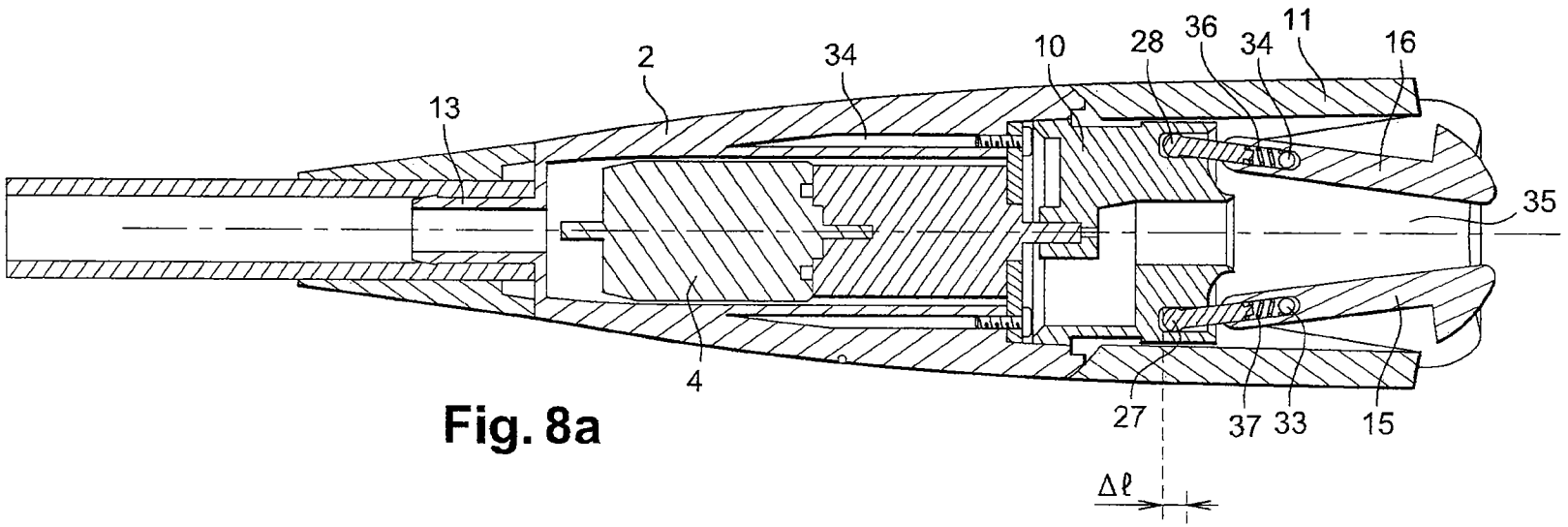
FIGS. 8*a* and 8*b* are diagrammatic representations in cross-section of one developed alternative of the invention, allowing an additional degree of freedom to be conferred on said clack valves.
Figure 8B:
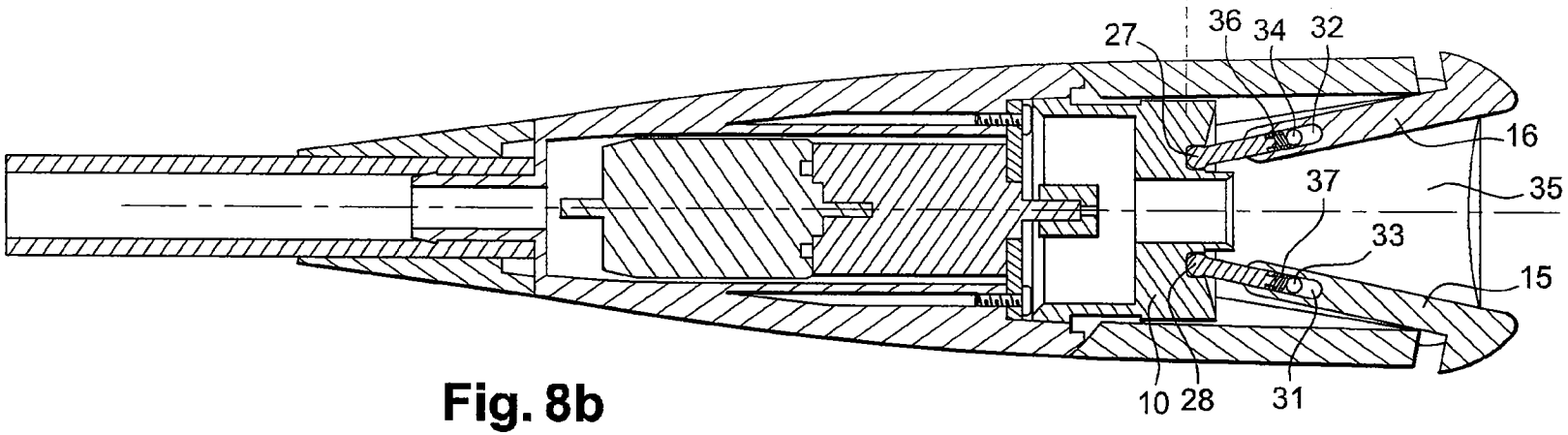
Figure 9A:
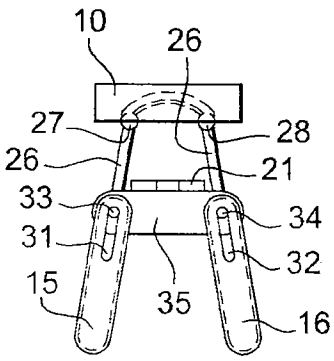
FIGS. 9*a* to 9*d* illustrate different phases of cam rotation and of its action on the clack valves, in the context of the more developed version of the invention targeted in FIGS. 8*a* and 8*b*.
Figure 9B:
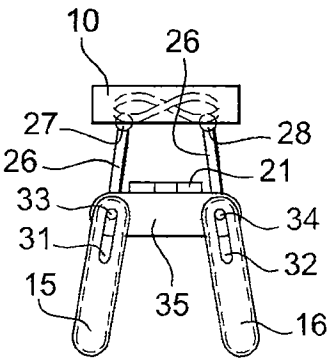
Figure 9C:
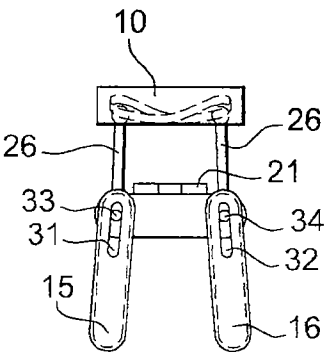
Figure 9D:
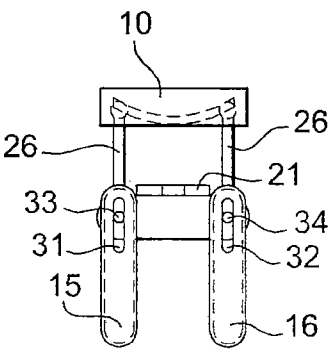
Figure 10A:
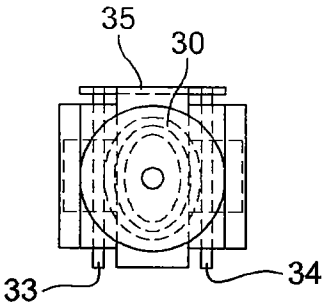
FIGS. 10*a* to 10*d* are diagrammatic representations of the four previous phases seen from above.
Figure 10B:
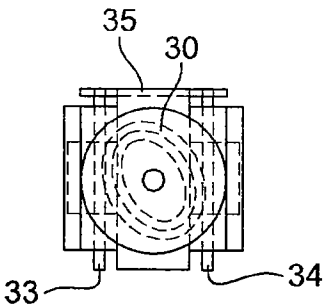
Figure 10C:
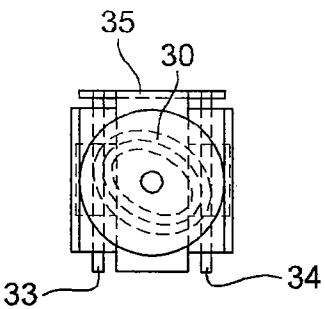
Figure 10D:
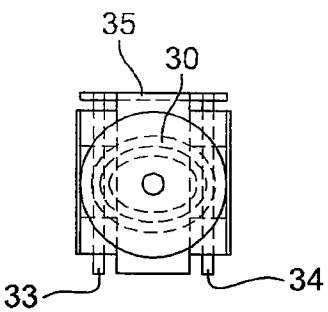

According to one advantageous version of the invention, more particularly described in relation to FIGS. 8 to 10, the clack valves 15 and 16 are given an additional degree of freedom, comprising a vertical movement (in said figures) thereof.

To this end, an aperture 31, 32, is provided in the upper area of each of said clack valves, in the case in point a through aperture, extending linearly in accordance with the principal dimension of each of them. Additionally, the platform 21 fulfilling the carrier function for said clack valves is extended in the direction of the lower end of the massage head by a lateral wall 35, with two axes 33, 34 coming from it, shown horizontally in the figures, and generally orientated perpendicularly relative to the principal dimension of the clack valves or apertures. Said axes 33, 34 pass through and engage with the apertures 31, 32, and hold the clack valves within the body 2, 11.

Two springs, 36 and 37 respectively, whereof one of the points of application comprises the axes 33 and 34, and exerting their thrust in the direction of the cam 10 on account of the positioning of their other point of application on the axis 25, 26 extending each of the two clack valves, cause the clack valves to be placed in the upper position, in other words tend to push said clack valves systematically against the cam path.

Quite clearly, in this configuration, said clack valves are no longer connected to the platform 21 by a hinge, of the type described (referenced as 23 and 24) in the previous embodiment, so that said clack valves can in fact be allowed to travel vertically.

In FIGS. 9*a* to 9*d*, and in FIGS. 10*a* to 10*d* has been shown the positioning of the cam 10, for 0°, 30°, 60° and 90° respectively. The variation in altitude Δl of the clack valves can thus be seen as a function of the cam rotation.

In doing this, skinfold formation is promoted, finally making it possible to dispense with all suction sources. What is more, a "face-lift" effect can be achieved on the treated skin, since at the same time as the skin is pinched between the clack valves, i.e. when they are in the closed position (FIG. 8*b*), the skinfold so pinched is pulled by an amplitude Δl.

In doing this skin elasticity, tone and firmness are worked.

Figure 11:
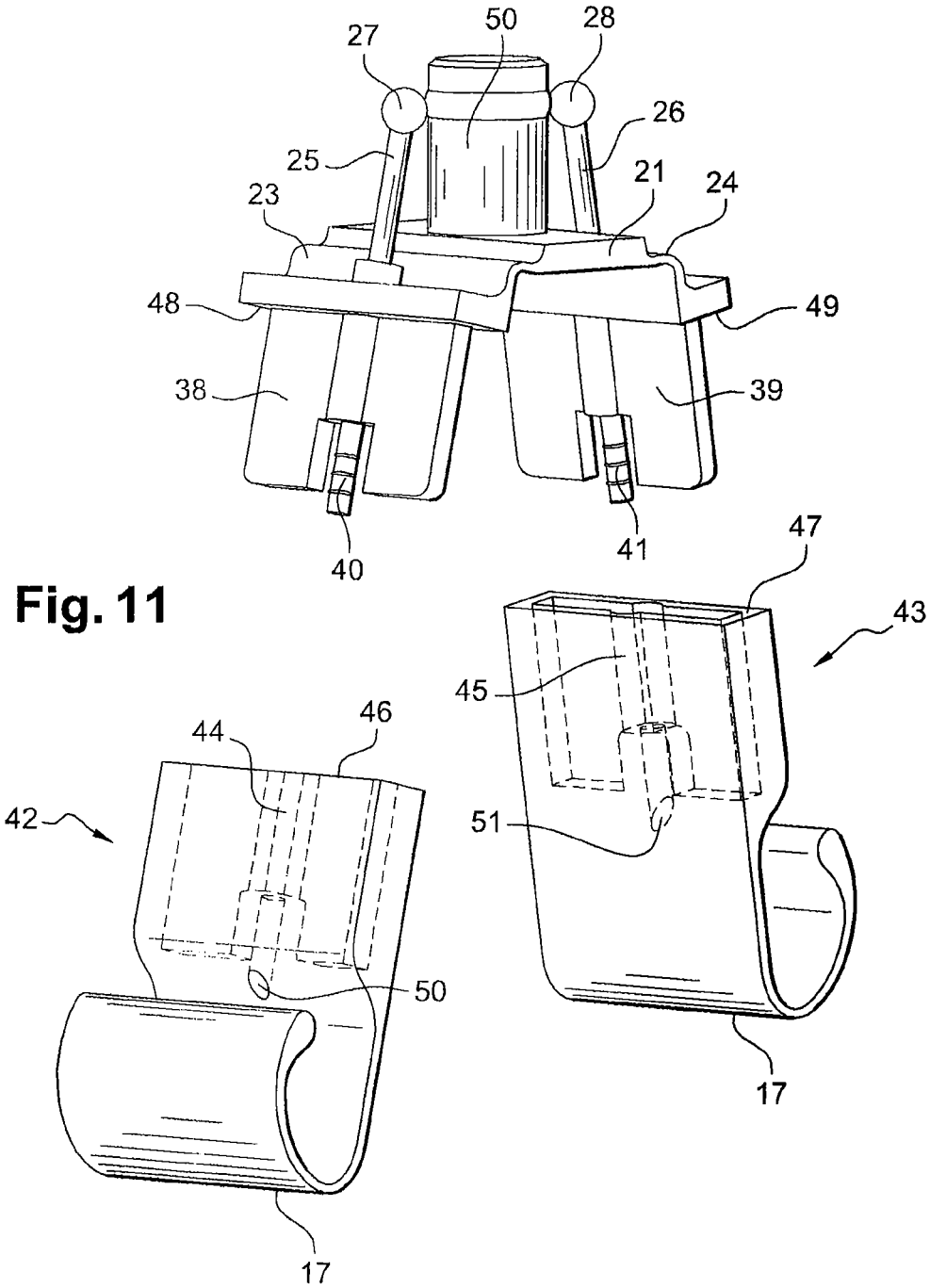
FIG. 11 is a diagrammatic view in exploded perspective of one alternative embodiment of the invention.

Another alternative of the inventive massage head has been shown in relation to FIGS. 11 and 12.

According to this alternative, the active area of the massage head includes firstly a single structural entity, added to the rest of said head. Said structural entity comprises the platform 21 complete with "caudron" fitting 50, and with two rigid sub-plates 38, 39 coming from it, articulated on two opposite edges of said platform by hinges 23, 24.

The sub-plates 38, 39 are each extended by an axis 25 and 26, perpendicular to the axis of articulation of said sub-plates on the platform 21, and whereof the free end is provided with a ball joint 27 and 28 respectively, intended to engage with the cam path 30 provided in the cam 10.

The active part of the clack valves, intended to come into contact with the skin, comprises an independent area 42, 43 which is fixed onto the respective sub-plates 38, 39, said areas being provided to this end with a housing of complementary shape 44, 45, until the upper edge 46, 47 of said areas is pressed against a shoulder 48, 49 provided on said sub-plates.

Said areas 42, 43 are actually secured to the respective sub-plates 38, 39 for example by engagement of the lower end of the axes 25, 26, fitted to this end with radial excrescences 40, 41, with a dedicated housing 50, 51 extending the housings 44, 45.

The assembly constituted by the platform 21, the "caudron" fitting 50 and the sub-plates 38, 39 is to advantage made out of a plastic material and is cast in one piece. In this instance, said sub-plates are drilled with a through orifice, so that the axes 25, 26 can be inserted, the latter being additionally fitted with a radial projection 51, 52 which presses against the upper edge of the sub-plates, thereby restricting the travel thereof and fulfilling their function of transmitting motion to the clack valves.

Figure 12B:
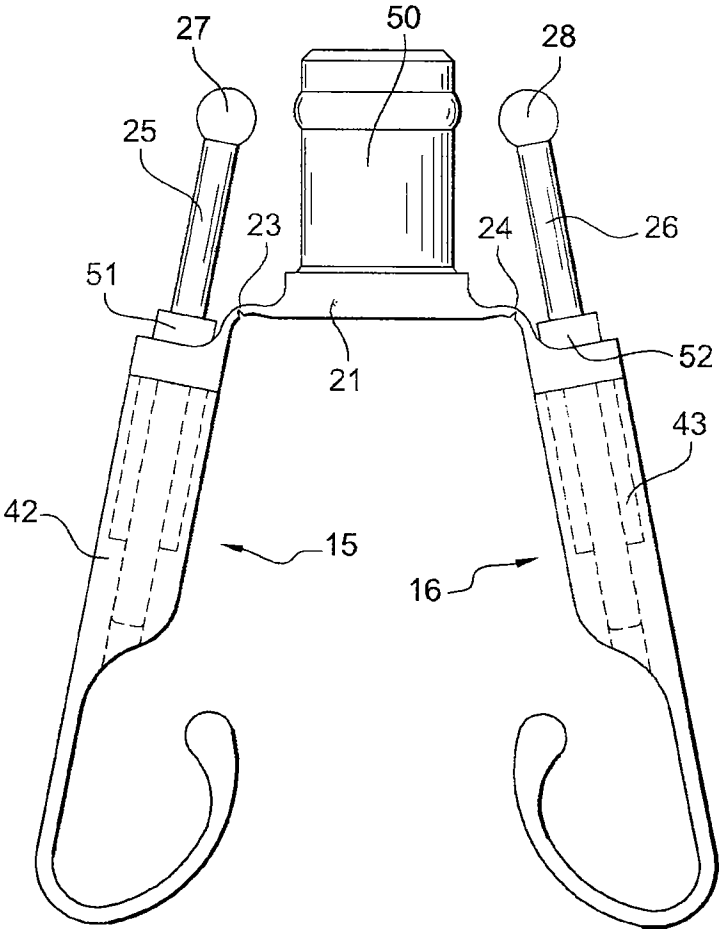
FIGS. 12*a* and 12*b* are diagrammatic representations seen from the side of two embodiments of said alternative. An illustration has therefore been given in relation to FIG. 1 of an exploded diagrammatic representation of the massage head 1 in accordance with the invention.
Figure 12A:
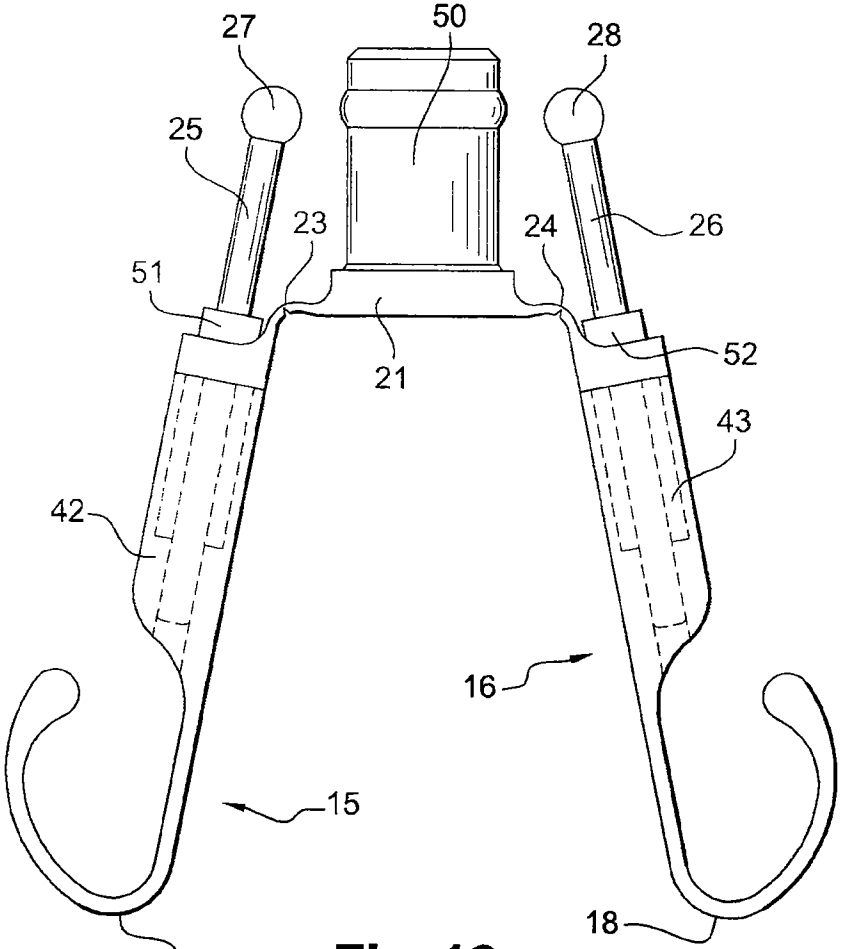

As can be seen in FIGS. 12*a* and 12*b*, the areas 42, 43 can adopt different configurations, as chosen by the operator. Additionally, they can be made out of different materials, and in particular out of flexible and/or abrasive material, or even support scented odours or generate an ice-cube effect, such as for example polypropylene, polyethylene or polyurethane.

As stated previously, it is possible to combine said massage head with a vacuum or negative pressure source, particularly in the event of the clack valves not having the additional degree of freedom, as described in relation to FIGS. 8 to 10. In this configuration, air passes in the body 2, 11 around the electric motor 4. Skinfold formation within the internal chamber between said clack valves can thus be enhanced and the skin tissue can therefore be worked more deeply. What is more, it is possible with said suction, which can be regulated, to apply massage treatment to the skinfold produced which is or is not continuous.

By employing a solenoid valve, which, as stated in the preamble, can be used to provide an on-off operating control, but which can also be used to specify a controlled rate of airflow between two pre-set values, with the possibility of adjustment between said values, it is possible to play on the synchronism or conversely on the random character between the flutter frequency of the clack valves (mechanically) and the frequency of the suction phases, thereby promoting blood and lymphatic circulation, or to obtain a "stretching" effect.

On account of this conjunction of means, a more effective massaging pinching action is achieved particularly in terms of firming up the skin.

The invention claimed is:

1. A massage head comprising:

a case defining an internal chamber in which a skinfold is formed when it is applied to the skin of a patient, the chamber being defined and continuously bounded by two lateral walls and by two transverse walls and having an opening on an end for application to the skin, said transverse walls each comprising a clack valve, each clack valve comprising a lower edge configured to contact the skinfold and an upper end opposite to said lower edge;

a motorized rotary cam defining a cam path and engaging with the upper end of each clack valve, wherein a rotation of said cam causes lower edges of each clack valve to move from a first position contacting said case to a second position closer to each other;

wherein the upper end of each of the clack valves opposite the lower edge thereof is articulated on a platform so that said clack valves can swivel and so that the lower edges can move closer to one another or move further apart, said platform and said clack valves cast in one piece, said platform comprising a resilient hinge to allow the end to articulate.

2. A massage head as claimed in claim 1, wherein the upper end comprises a ball joint, the ball joint added by means of an axis integral with the upper end of the clack valves, opposite the lower edge thereof in contact with the patient's skin, the ball joint located in the chamber.

3. A massage head as claimed in claim 1, wherein the cam comprises only one cam path for the two clack valves, said cam path comprising at least one eccentric, and displaying symmetry relative to at least one axis passing through a plane of which said cam is part and through the center of rotation of said cam.

4. A massage head as claimed in claim 3, wherein the cam path is ellipsoidal.

5. A massage device employing a massage head as claimed in claim 1, and comprising an electrical power source suitable for actuating an electric motor included in the massage head and rotating the cam.

6. A massage device as claimed in claim 5, further comprising a vacuum or negative pressure source, communicating with the massage head, and intended to generate within the internal chamber thereof a negative pressure capable of generating suction on the patient's skin, and forming the skinfold within said internal chamber.

7. A massage device as claimed in claim 6, wherein the vacuum or negative pressure source is controlled by means of a solenoid valve.

8. A massage device as claimed in claim 7, wherein the frequency of suction phases generated by the vacuum or negative pressure source and the frequency of clack valve flutter is synchronous.

9. A massage device as claimed in claim 7, wherein the frequency of suction phases generated by the vacuum or negative pressure source and the frequency of clack valve flutter is not synchronous.

10. The system of claim 1 further comprising a vacuum or negative pressure source in communication with the internal chamber to generate within the chamber a negative pressure for generating suction on the skin of the patient and forming the skinfold within the internal chamber.

11. The head of claim 1 wherein said motor rotary cam is located in the chamber.

12. A massage head comprises:

a case defining an internal chamber in which a skinfold is formed when it is applied to the skin of a patient;

the chamber being defined and continuously bounded by two lateral walls and by two transverse walls and having an opening on an end for application to the skin of the patient;

said transverse walls each comprising a clack valve, each clack valve comprising a lower edge configured to contact the skinfold and an upper end opposite to the lower edge, the clack valves connected to each other at a resilient hinge, the hinge comprising an aperture to allow a communication of a vacuum to the chamber through the hinge, the hinge and clack valves being monolithic relative to each other and allowing movement of the lower edge of each clack valve toward each other; and a motorized rotary cam defining a cam path and engaging with the upper end of each clack valve to cause a pivotal movement of the lower edge of each clack valve toward each other about the hinge.

13. The head of claim 12 further comprising a vacuum or negative pressure source in communication with the internal chamber through the aperture to generate within the chamber a negative pressure for generating suction on the skin of the patient and forming the skinfold within the internal chamber.

14. The head of claim 12 wherein said cam is located in the chamber.

15. The head of claim 12 wherein the upper end of each clack valve comprises a ball joint located in the chamber.

* * * * *